United States Patent [19]

Coop

[11] 4,002,260

[45] Jan. 11, 1977

[54] PRY-OFF CLOSURE

[75] Inventor: Jackie A. Coop, New Lisbon, Ind.

[73] Assignee: Aluminum Company of America, Pittsburgh, Pa.

[22] Filed: Sept. 25, 1975

[21] Appl. No.: 616,569

[52] U.S. Cl. ..... 215/305

[51] Int. Cl.[2] ..... B65D 41/12

[58] Field of Search ..... 215/253, 305, 304

[56] References Cited

UNITED STATES PATENTS

| | | | |
|---|---|---|---|
| 2,490,791 | 12/1949 | Erb | 215/305 |
| 3,137,403 | 6/1964 | Welber | 215/305 |
| 3,275,178 | 9/1966 | Lovell | 215/305 X |
| 3,589,543 | 6/1971 | Weigand | 215/253 X |
| 3,858,742 | 1/1975 | Grussen | 215/253 |
| 3,865,268 | 2/1975 | Coop | 215/253 |

*Primary Examiner*—Donald F. Norton
*Attorney, Agent, or Firm*—David W. Brownlee

[57] ABSTRACT

A sheet metal closure having a main body mountable to the mouth of a container. The closure main body includes a depending skirt extending peripherally around the neck of the container. A continuous ring is integrally attached to a portion of the skirt with the skirt including a plurality of flutes tightly gripping the container. The ring may be pivoted about its attachment to the skirt thereby expanding at least some of the flutes enabling the closure to be removed from the container.

3 Claims, 5 Drawing Figures

PRY-OFF CLOSURE

BACKGROUND OF THE INVENTION

1. Field of the Invention

This invention is in the field of container closures.

2. Description of the Prior Art

Bottle containers in which various drinks are sold, are sealed by metal caps including flutes formed in the depending skirt of the cap to secure the cap to the container. These caps may be removed by a pry-off bottle opener. In many cases, a bottle opener is not available and thus, the container may not be readily opened. In order to alleviate this problem, closures have been provided which screw on to the container. The screw on type closures require threaded container necks and are more costly as compared to the traditional pry-off closure.

In my co-pending patent application Ser. No. 531,627, filed Dec. 11, 1974, now Pat. No. 3,931,904, there is disclosed a tear off closure which is mountable to the traditional bottle container without requiring external threads on the neck of the container. The closure is provided with a pull ring which may be pulled upwardly thereby tearing the closure facilitating the removal of the closure from the container. The closure is not provided with the flutes in accordance with the conventional design but instead includes a skirt portion constricted beneath the annular bead of the container mouth. By pivoting the pull ring the closure is torn across the mouth of the container. To facilitate the tearing, the closure is produced from a material such as aluminum.

Many closures are produced from a relatively strong material such as steel. The stronger type closures resist tearing and as a result, it is desirable to provide a closure having a pull ring which does not require tearing of the closure or skirt material. Disclosed herein is such a closure which includes a plurality of flutes securing the closure to the container neck with a pull ring provided which expands at least some of the flutes upon the pivoting of the pull ring thereby allowing for the removal of the closure.

DESCRIPTION OF THE PREFERRED EMBODIMENT

Figure 1:
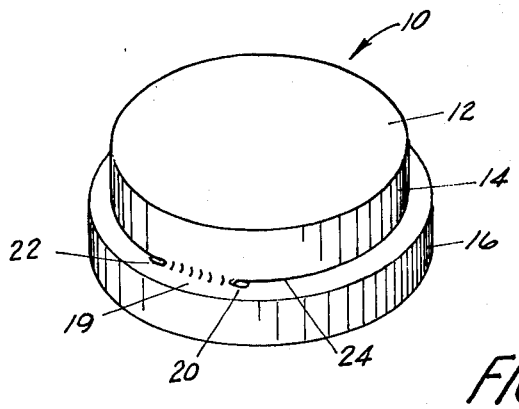
FIG. 1 is a perspective view of a closure incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a pry-off closure 10 incorporating the present invention. Closure 10 includes a top panel 12 which is adapted to overlie the entrance mouth of a container. A closure skirt 14 depends from the periphery of the top panel 12 with an integral pull ring 16 extending around the bottom edge of the closure skirt and projecting outwardly and downwardly from the bottom edge. Frangible score means 24, such as a score line or a plurality of spaced slits and bridges, preferably connect the pull ring to a portion of closure skirt 14 prior to application of the closure on a container mouth. Frangible means 24 is adapted to be severed or broken when the closure is sealed on a container by crimping or otherwise constricting a portion of the closure skirt inwardly towards the container neck.

Figure 4:
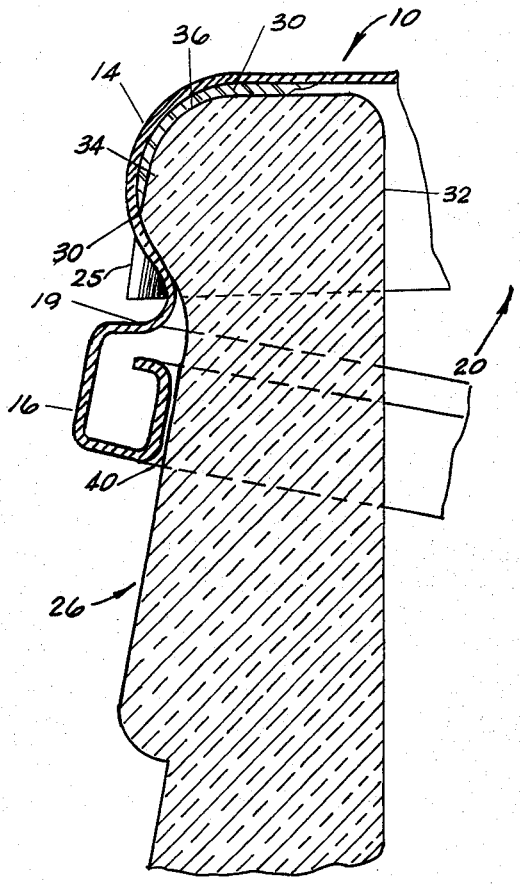
FIG. 4 is a fragmentary cross-sectional view through the container and closure of FIG. 2.
Figure 5:
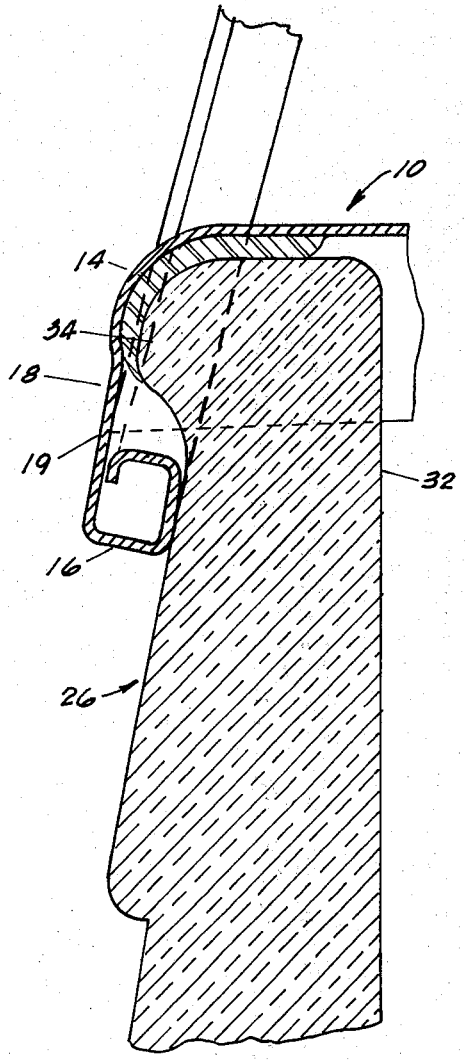
FIG. 5 is the same view as FIG. 4 only showing the pull ring pivoted with some of the flutes expanded.

Skirt 14 includes a plurality of flutes 18 (FIG. 2) which are formed when the closure is mounted to the container neck. The substantially rigid pull ring 16 is disposed generally beneath the bottom edge 17 of skirt 14 and is substantially concentric with the skirt and integrally connected to the skirt. During the mounting of closure 10 to container 26, ring 16 is separated from skirt 14 except for portion 19 of skirt 14 which is an extension of the skirt. Pull ring 16 comprises a bead (FIG. 4) which is curled inwardly from the connection of ring 16 by extension 19 to skirt 14. The ring is adapted to be cammed against the neck of container 26 below the connection of the ring to the extension when the ring is pivoted upwardly in the direction of arrow 20 as shown in FIGS. 4 and 5. As the ring is pivoted upwardly, at least a portion of extension 19 of skirt 14 partially wraps around ring 16. Ring 16 is in the form of a curled bead which initiates expansion of at least some of the flutes 18 during the upward pivoting movement of the ring to then allow the closure to be lifted off of the container.

Figure 2:
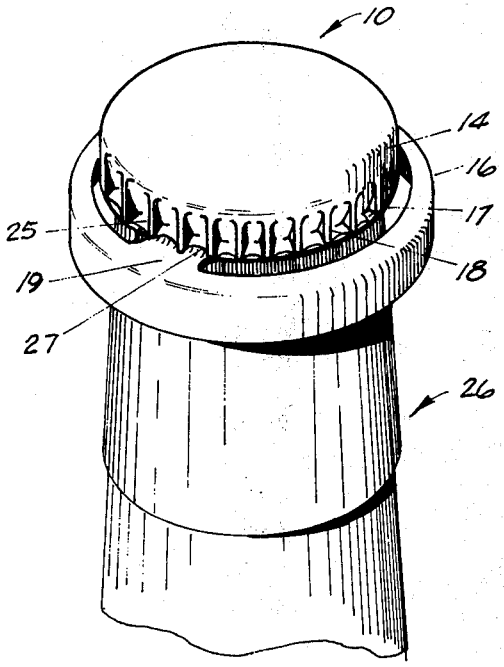
FIG. 2 is a fragmentary perspective view of a container having the closure of FIG. 1 mounted thereon.

The container closure combination shown in FIG. 2 includes the improvement of the skirt 14 having a plurality of flutes 18 formed thereon so as to secure the closure to the container with the skirt being integrally connected to the pull ring which is adapted to be cammed against the container neck below the connection to skirt 14 when the ring is pivoted and to partially wrap the end of the skirt or extension at 19 around a portion of the pull ring 16 and initiate expansion of the flute and closure skirt.

Container 26 (FIG. 4) has an outwardly projecting annular bead 34 around its entrance mouth 32. The top panel 12 of closure 10 extends across the mouth with the depending skirt 14 extending around the periphery of the top panel whereas the pull ring 16 is generally concentric at the bottom edge of the skirt. The plurality of expansion crimps or flutes 18 extend toward the top panel 12 with the pull ring 16 including a curled bead integrally connected via an extension 19 to the outer end of skirt 14 to facilitate expansion of the crimp or flutes for removal of the closure from container 26.

Prior to installation of closure 10 to the container, a score line 24 extends from hole 20 provided between skirt 14 and ring 16 around the closure to an opposite hole 22 also provided between the skirt and ring. Score line 24 extends partially around the closure between the skirt and the ring having opposite ends terminating at holes 20 and 22. Holes 20 and 22 limit the severence of the means connecting ring 16 to skirt 14 to only along score line 24. Thus, the ring is integrally connected to extension 19 which is positioned between holes 20 and 22 without any score lines being provided on extension 19. The pull ring is then severed from the skirt except between holes 20 and 22 at extension 19 which is integrally attached to and between the skirt and the ring. The ring is severed from the skirt along score line 24 as the closure is installed on the container during the formation of flutes 18. As the ring is pivoted upwardly in direction of arrow 20, the flutes will expand. For example, flute 25 and 27 provided on the opposite sides of extension 19 will expand as the pull ring is pivotedly upwardly. As shown in the drawing, extension 19 extends less than 180° around the entrance mouth 32 of the container. It is anticipated that extension 19 will extend approximately 30° around the longitudinal center axis extending through mouth 32.

Flutes 18 extend along and under the annular outwardly projecting bead 34 of container 26. The pull ring 16 is positioned beneath flutes 18 and is disposed closely adjacent container at the attachment of the ring to extension 19 and is inclined downwardly from the extension to the free end of the ring on the side of the container opposite extension 19. The annular bead 34 has an upwardly-outwardly facing rounded upper surface 36 and a generally downwardly facing under surface 38. Closure 10 is provided with a gasket material or sealing material 30 positioned between the annular bead and the closure. Gasket 30 is compressed against surface 36 to provide a seal between the closure and the container. Flutes 18 lock the closure on the container and hold the sealing material 30 under compression to provide an effective seal between the closure and container.

Pull ring 16 is in the form of a bead curled inwardly from its connection to the skirt at extension 19. The curled bead has a preferably substantially oval or eliptical cross-sectional configuration with its major axis substantially parallel to the exterior surface of the container mouth inwardly of the bead. The cross-sectional configuration of the ring 16 helps to cam extension 19 outwardly to initiate expansion of flutes 18 as the pull ring is pivoted upwardly.

Figure 3:
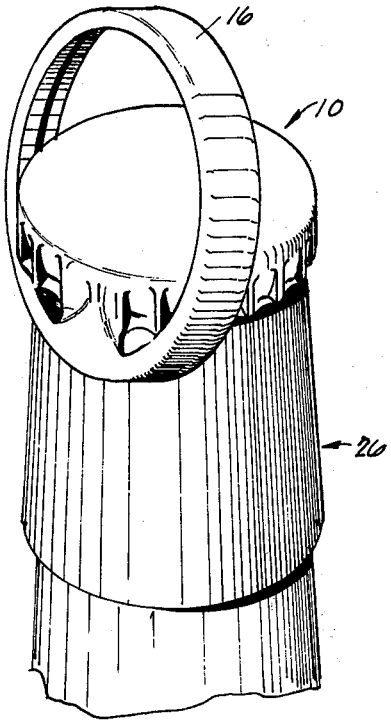
FIG. 3 is the same view as FIG. 2 only showing the pull ring of the closure pivoted causing some of the flutes to expand.

Pull ring 16 is disposed around the container neck below the bottom edge of skirt 14 and is adapted to engage the container neck when the opposite or free end of the pull ring is lifted from around the bottle neck to the position illustrated in FIGS. 3 and 5. The curled bead which forms pull ring 16 is substantially rigid so it will not be materially deformed when the free end is lifted. Instead, lifting the free end of pull ring 16 engages the curled bead against the outwardly facing surface on the container neck and turns or rotates the bead from its initial position with its major axis parallel to the outwardly facing surface 40 of the container neck to a position in which the bead's major axis is substantially perpendicular to surface 40. Such rotation of the bead partially laps extension 19 about the inwardly curled bead and cams the attached end of the pull ring and the terminal end of extension 19 outwardly thereby initiating expansion of flutes 18 in skirt 14. Once the expansion of the flutes has been initiated by pivoting the ring upwardly, it is a simple matter for the consumer to continue to pivot the ring upwardly away from the container mouth thereby lifting the closure from the container.

It is anticipated that the flutes will be added during the capping operation of the closure to the container. The flutes will be formed as the ring is broken loose from the skirt except in the area of extension 19. It is anticipated that the cap will be produced from a flat piece of metal which is blanked, drawn and then curled. Due to the fact that flutes are provided, the closure is not stretched or torn as the pull ring is pivoted upwardly during the removal of the closure from the container. Production of the prior art closure which does not include flutes but instead which has a depending skirt constricted around the annular bead of the container is produced by blanking the closure from a flat piece of metal. The score line is then provided with the next step being the drawing of the closure. During the drawing of the closure, difficulties have been encountered since the score line will break. The improved closure disclosed herein is produced by formation of the score line during the drawing of the closure thereby alleviating the aforementioned problem. It is anticipated that twenty one flutes will be provided on the closure although the number of flutes may be varied. The cross-sectional configuration of the pull ring may be varied. For example, in lieu of an oval cross-sectional configuration, the pull ring may have a heart shaped configuration with the opposite edges of the pull ring being tucked inwardly into the bead of the pull ring.

While there have been described above the principles of this invention in connection with specific apparatus, it is to be clearly understood that this description is made only by way of example and not as a limitation in the scope of the invention.

What is claimed is:

1. In a container-closure combination including a container having an upwardly projecting substantially cylindrical neck portion with an entrance mouth therein and an externally disposed bead around the neck portion adjacent the entrance mouth and a sheet metal closure secured on the container including a top panel over the container entrance mouth, a depending skirt around the periphery of the top panel, said skirt including a plurality of flutes securing the closure on the container and a substantially rigid pull ring disposed generally beneath the bottom edge of said skirt substantially concentric with the skirt and integrally connected to said skirt, said pull ring comprising a bead curled inwardly from the connection of the ring to said skirt and disposed adjacent the container neck below the ring connection to the closure skirt to be cammed against the container neck when the ring is pivoted to partially wrap the end of said skirt around a portion of the curled bead and initiate expansion of at least some of said flutes and allow said closure to be lifted off of said container.

2. A combination as set forth in claim 1 in which said curled bead in said pull ring has a generally oval cross sectional configuration with its major axis substantially parallel to the closure skirt.

3. A combination as set forth in claim 1 in which said skirt has an extension extending less than 180° around the entrance mouth with the extension integrally connected to said pull ring and wrapping at least partially around the pull ring as the pull ring is pivoted upwardly about its attachment to said extension.

* * * * *